US006454136B1

(12) United States Patent
Evans

(10) Patent No.: US 6,454,136 B1
(45) Date of Patent: Sep. 24, 2002

(54) EXTENDABLE CAULKING GUN

(76) Inventor: Clyde Evans, 1804 W. Algonquin, Lake in the Hills, IL (US) 60102

( * ) Notice: Subject to any disclaimer, the term of this patent is extended or adjusted under 35 U.S.C. 154(b) by 0 days.

(21) Appl. No.: 09/872,024

(22) Filed: Jun. 1, 2001

(51) Int. Cl.[7] ..... B67D 5/64

(52) U.S. Cl. ..... 222/174; 222/326; 222/327; 222/309; 222/391

(58) Field of Search ..... 222/391, 287, 222/309, 174, 326, 327

(56) References Cited

U.S. PATENT DOCUMENTS 2,128,254 A * 8/1938 Kile ..... 221/102
3,140,015 A * 7/1964 Sherbondy ..... 222/192
3,512,684 A * 5/1970 Sutton, Sr. ..... 222/327
3,726,440 A * 4/1973 Deeb ..... 222/174
3,977,570 A * 8/1976 Smrt ..... 222/174
4,262,822 A * 4/1981 Corte ..... 222/174
4,932,565 A * 6/1990 Paradiso ..... 222/174
4,979,649 A * 12/1990 Wescott ..... 222/174
5,743,431 A * 4/1998 Brattesani ..... 222/1

* cited by examiner

*Primary Examiner*—Lesley D. Morris
*Assistant Examiner*—Frederick C. Nicolas
(74) *Attorney, Agent, or Firm*—Goldstein & Lavas, P.C.

(57) ABSTRACT

An extendable caulking gun including a cylindrical housing having an open first end, an open second end, and a hollow interior. A trigger assembly is coupled with respect to the open first end of the cylindrical housing. The trigger assembly includes an L-shaped trigger housing secured to the open first end of the cylindrical housing. A caulk tube holder is slidably received within the open second end of the cylindrical housing. The caulk tube holder is adapted for holding a tube of caulk therein. The caulk tube holder is coupled with the trigger assembly.

2 Claims, 1 Drawing Sheet

EXTENDABLE CAULKING GUN

BACKGROUND OF THE INVENTION

The present invention relates to an extendable caulking gun and more particularly pertains to allowing caulk to be applied to normally hard to reach areas.

The use of extension tools is known in the prior art. More specifically, extension tools heretofore devised and utilized for the purpose of allowing hard to reach areas to be reached are known to consist basically of familiar, expected and obvious structural configurations, notwithstanding the myriad of designs encompassed by the crowded prior art that have been developed for the fulfillment of countless objectives and requirements.

By way of example, U.S. Pat. No. 4,262,822 to Corte discloses an elongated caulking device for reaching remote locations; however, it appears to show the use of a first and second trigger assembly. U.S. Pat. No. 4,979,649 to Wescott discloses a caulking gun extension device with an auxiliary piston configuration. U.S. Pat. No. 4,258,884 to Rogers discloses a means for extending a caulking gun using a plurality of interlocking extension components for work beyond the reach of the conventional nozzle.

While these devices fulfill their respective, particular objective and requirements, the aforementioned patents do not describe an extendable caulking gun for allowing caulk to be applied to normally hard to reach areas.

In this respect, the extendable caulking gun according to the present invention substantially departs from the conventional concepts and designs of the prior art, and in doing so provides an apparatus primarily developed for the purpose of allowing caulk to be applied to normally hard to reach areas.

Therefore, it can be appreciated that there exists a continuing need for a new and improved extendable caulking gun that can be used for allowing caulk to be applied to normally hard to reach areas. In this regard, the present invention substantially fulfills this need.

SUMMARY OF THE INVENTION

In the view of the foregoing disadvantages inherent in the known types of extension tools now present in the prior art, the present invention provides an improved extendable caulking gun. As such, the general purpose of the present invention, which will be described subsequently in greater detail, is to provide a new and improved extendable caulking gun that has all the advantages of the prior art and none of the disadvantages.

To attain this, the present invention essentially comprises a cylindrical housing having an open first end, an open second end, and a hollow interior. A trigger assembly is coupled with respect to the open first end of the cylindrical housing. The trigger assembly includes an L-shaped trigger housing secured to the open first end of the cylindrical housing. The trigger housing has an adjustable rod extending inwardly of the hollow interior of the cylindrical housing. The adjustable rod has an outer end and an inner end. The outer end has a handle secured thereto disposed outwardly of the trigger housing. The trigger housing has a squeeze trigger pivotally coupled thereto and coupled with the adjustable rod. A caulk tube holder is slidably received within the open second end of the cylindrical housing. The caulk tube holder is adapted for holding a tube of caulk therein. The caulk tube holder is coupled with the inner end of the adjustable rod of the trigger assembly.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved extendable caulking gun that has all the advantages of the prior art extension tools and none of the disadvantages.

It is another object of the present invention to provide a new and improved extendable caulking gun that may be easily and efficiently manufactured and marketed.

It is a further object of the present invention to provide a new and improved extendable caulking gun that is of durable and reliable construction.

An even further object of the present invention is to provide a new and improved extendable caulking gun that is susceptible of a low cost of manufacture with regard to both materials and labor, and which accordingly is then susceptible of low prices of sale to the consuming public, thereby making such an extendable caulking gun economically available to the buying public.

Even still another object of the present invention is to provide a new and improved extendable caulking gun for allowing caulk to be applied to normally hard to reach areas.

Lastly, it is an object of the present invention to provide a new and improved extendable caulking gun including a cylindrical housing having an open first end, an open second end, and a hollow interior. A trigger assembly is coupled with respect to the open first end of the cylindrical housing. The trigger assembly includes an L-shaped trigger housing secured to the open first end of the cylindrical housing. A caulk tube holder is slidably received within the open second end of the cylindrical housing. The caulk tube holder is adapted for holding a tube of caulk therein. The caulk tube holder is coupled with the trigger assembly.

These together with other objects of the invention, along with the various features of novelty that characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various figures.

DESCRIPTION OF THE PREFERRED EMBODIMENT

Figure 1:
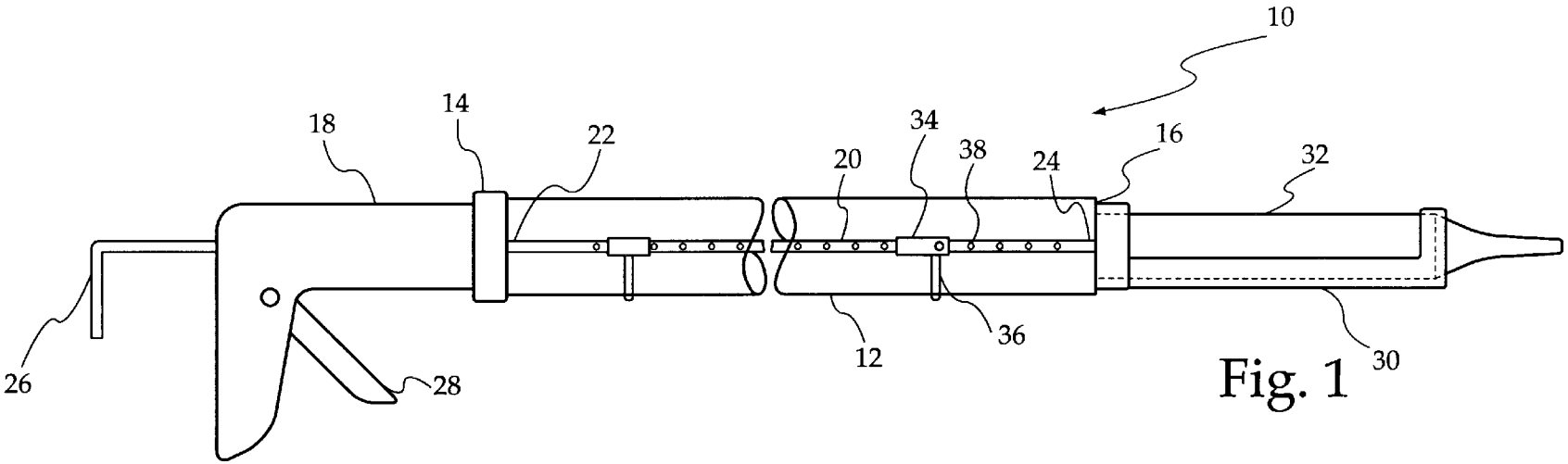
FIG. 1 is a side view of the preferred embodiment of the extendable caulking gun constructed in accordance with the principles of the present invention.
Figure 2:
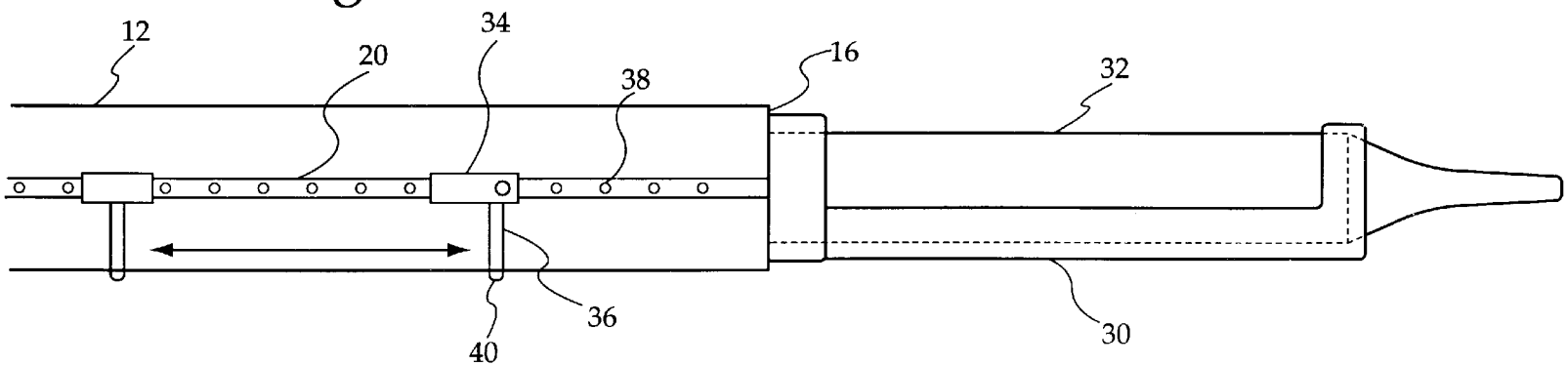
FIG. 2 is an enlarged side view of the present invention shown in cross-section.

With reference now to the drawings, and in particular, to figures one through two thereof, the preferred embodiment of the new and improved extendable caulking gun embodying the principles and concepts of the present invention and generally designated by the reference number 10 will be described.

Specifically, it will be noted in the various figures that the device relates to an extendable caulking gun for allowing caulk to be applied to normally hard to reach areas. In its broadest context, the device consists of a cylindrical housing, a trigger assembly, and a caulk tube holder. Such components are individually configured and correlated with respect to each other so as to attain the desired objective.

The cylindrical housing 12 has an open first end 14, an open second end 16, and a hollow interior.

The trigger assembly is coupled with respect to the open first end 14 of the cylindrical housing 12. The trigger assembly includes an L-shaped trigger housing 18 secured to the open first end 14 of the cylindrical housing 12. The trigger housing 18 has an adjustable rod 20 extending inwardly of the hollow interior of the cylindrical housing 12. The adjustable rod 20 has an outer end 22 and an inner end 24. The outer end 22 has a handle 26 secured thereto disposed outwardly of the trigger housing 18. The trigger housing 18 has a squeeze trigger 28 pivotally coupled thereto and coupled with the adjustable rod 20.

The caulk tube holder 30 is slidably received within the open second end 16 of the cylindrical housing 12. The caulk tube holder 30 is adapted for holding a tube of caulk 32 therein. The caulk tube holder 30 is coupled with the inner end 24 of the adjustable rod 20 of the trigger assembly.

The caulk tube holder 30 can be extended outwardly of the open second end 16 of the cylindrical housing 12 to a desired length. In the preferred embodiment, the extension of the caulk tube holder 30 can make the overall length of the device 10 extend between thirty-six and seventy-two inches. The adjustable rod 20 can be adjusted to accommodate the extension of the caulk tube holder 30. The adjustable rod 20 comprises a number of segments, in a co-linear relationship that are adjustably coupled by collars 34 each having a removable cotter pin 36 that can mate with apertures 38 in the segments. Free ends 40 of the cotter pins 36 extend outwardly of the cylindrical housing 12 to allow for easy manipulation by the user to selectively adjust the length of the adjustable rod 20.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An extendable caulking gun for allowing caulk to be applied to normally hard to reach areas comprising, in combination:

a cylindrical housing having an open first end, an open second end, and a hollow interior;

a trigger assembly coupled with respect to the open first end of the cylindrical housing, the trigger assembly including an L-shaped trigger housing secured to the open first end of the cylindrical housing, the trigger housing having an adjustable rod extending inwardly of the hollow interior of the cylindrical housing, the adjustable rod having an outer end and an inner end, the outer end having a handle secured thereto disposed outwardly of the trigger housing, the trigger housing having a squeeze trigger pivotally coupled thereto and coupled with the adjustable rod wherein the rod is adjusted by means of collars having cotter pins extended through apertures in the adjustable rod; and a caulk tube holder slidably received within the open second end of the cylindrical housing, the caulk tube holder adapted for holding a tube of caulk therein, the caulk tube holder being coupled with the inner end of the adjustable rod of the trigger assembly.

2. An extendable caulking gun for allowing caulk to be applied to normally hard to reach areas comprising, in combination:

a cylindrical housing having an open first end, an open second end, and a hollow interior;

a trigger assembly coupled with respect to the open first end of the cylindrical housing, the trigger assembly including an L-shaped trigger housing secured to the open first end of the cylindrical housing, the trigger housing having an adjustable rod extending inwardly of the hollow interior of the cylindrical housing, the adjustable rod having an outer end and an inner end, the outer end having a handle secured thereto disposed outwardly of the trigger housing, the inner end coupled with the caulk tube holder, the trigger housing having a squeeze trigger pivotally coupled thereto and coupled with the adjustable rod wherein the rod is adjusted by means of collars having cotter pins extended through apertures in the adjustable rod; and a caulk tube holder slidably received within the open second end of the cylindrical housing, the caulk tube holder adapted for holding a tube of caulk therein, the caulk tube holder being coupled with the trigger assembly.

* * * * *